US011203470B2

(12) United States Patent
Ezra et al.

(10) Patent No.: US 11,203,470 B2
(45) Date of Patent: Dec. 21, 2021

(54) MODULAR BOTTLE CLOSURE FOR COUPLING AND ASSEMBLY

(76) Inventors: Ben Ezra, Petach Tikva (IL); Eyal Ovadya, Mitzpe Ramon (IL); Harel Shwarts, Petach Tikva (IL)

( * ) Notice: Subject to any disclaimer, the term of this patent is extended or adjusted under 35 U.S.C. 154(b) by 668 days.

(21) Appl. No.: 13/059,364

(22) PCT Filed: Jun. 2, 2009

(86) PCT No.: PCT/IL2009/000552
§ 371 (c)(1),
(2), (4) Date: Feb. 16, 2011

(87) PCT Pub. No.: WO2010/023652
PCT Pub. Date: Mar. 4, 2010

(65) Prior Publication Data

US 2011/0139745 A1 Jun. 16, 2011

(30) Foreign Application Priority Data

Aug. 25, 2008 (IL) ..... 193662

(51) Int. Cl.
*B65D 51/24* (2006.01)
*B65D 81/36* (2006.01)

(52) U.S. Cl.
CPC ..... *B65D 51/24* (2013.01); *B65D 81/361* (2013.01); *B65D 2251/065* (2013.01)

(58) Field of Classification Search
CPC ..... B65D 81/361; B65D 51/24; E05B 2/02; A63H 33/04
USPC ..... 206/503, 508, 509, 511, 512; 215/226, 215/228, 263, 277, 302, 305, 370–372, 215/376, 390, 391; 220/212, 254.1, 220/254.7–254.9, 256.1, 259.3–259.5,
(Continued)

(56) References Cited

U.S. PATENT DOCUMENTS 2,195,257 A * 3/1940 Paris ..... 220/304
2,631,747 A * 3/1953 Stolte ..... 215/10
3,303,953 A * 2/1967 Frank ..... 215/228
(Continued)

FOREIGN PATENT DOCUMENTS

CH 642321 A5 * 4/1984
CN 2571697 Y * 9/2003
(Continued)

OTHER PUBLICATIONS

International Search Report of corresponding PCT application—2 pages—dated Sep. 2, 2009.

*Primary Examiner* — Anthony D Stashick
*Assistant Examiner* — Raven Collins

(57) ABSTRACT

A modular bottle closure comprises one or more exterior surfaces defining a hollow interior, a plurality of spaced engagement elements outwardly protruding from the exterior surfaces, a bottle cap interface element formed within the interior, and a coupling section coinciding with, or recessed from, a terminal edge of the closure. The coupling section frictionally engages engagement elements of another closure, whereby to couple together one or more closures. The plurality of engagement elements, which may protrude from the upper surface, are arranged by regions. A side of each engagement element of a region defines a locus of contact surfaces of substantially equal shape and length as the perimeter of the selected coupling section portion.

11 Claims, 14 Drawing Sheets

(58) Field of Classification Search
USPC ..... 220/315, 376, 379, 380, 625, 628–630, 220/636, 729
See application file for complete search history.

(56) References Cited

U.S. PATENT DOCUMENTS

| | | | | | |
|---|---|---|---|---|---|
| 3,374,917 | A * | 3/1968 | Troy | 220/23.4 | |
| 3,487,579 | A * | 1/1970 | Brettingen | 446/128 | |
| 3,616,943 | A * | 11/1971 | Brink | 206/508 | |
| 3,684,115 | A * | 8/1972 | Birch | B65D 50/068 | 215/215 |
| 3,713,247 | A * | 1/1973 | Parrilla | 446/71 | |
| 3,730,025 | A * | 5/1973 | Monnerjahn | 81/3.4 | |
| 4,273,248 | A * | 6/1981 | Lehmann | B65D 41/0478 | 215/331 |
| 4,284,201 | A * | 8/1981 | Nixon | B65D 50/041 | 215/220 |
| 4,582,447 | A * | 4/1986 | Itoh | 403/305 | |
| 4,591,063 | A * | 5/1986 | Geiger | 215/330 | |
| 4,829,618 | A * | 5/1989 | McKee | 7/151 | |
| 4,919,268 | A * | 4/1990 | Young et al. | 206/509 | |
| 4,964,833 | A * | 10/1990 | Suzuki | 446/118 | |
| 5,035,324 | A * | 7/1991 | Bertrand | 206/457 | |
| 5,054,617 | A * | 10/1991 | Young et al. | 206/509 | |
| D321,648 | S * | 11/1991 | Ricci | D9/600 | |
| 5,178,276 | A * | 1/1993 | Sheets | 206/427 | |
| D333,094 | S * | 2/1993 | Zutler | D9/423 | |
| D333,615 | S * | 3/1993 | Zutler | D3/294 | |
| D335,159 | S * | 4/1993 | Olsen | D21/503 | |
| 5,361,919 | A * | 11/1994 | Hull et al. | 215/228 | |
| 5,392,945 | A * | 2/1995 | Syrek | 220/608 | |
| D356,255 | S * | 3/1995 | Syrek | D9/424 | |
| 5,447,249 | A * | 9/1995 | Vickers | 220/23.83 | |
| 5,507,389 | A * | 4/1996 | Syrek | 206/508 | |
| 5,653,621 | A * | 8/1997 | Yao | A63H 33/082 | 446/127 |
| 5,676,251 | A * | 10/1997 | Credle, Jr. | 206/501 | |
| 5,709,304 | A * | 1/1998 | Credle, Jr. | 206/501 | |
| D399,108 | S * | 10/1998 | Koefelda | D8/38 | |
| 5,876,776 | A * | 3/1999 | Credle, Jr. | 426/394 | |
| 5,890,595 | A * | 4/1999 | Credle, Jr. | 206/501 | |
| 6,050,044 | A * | 4/2000 | McIntosh | A63H 33/082 | 446/124 |
| 6,085,919 | A * | 7/2000 | Singer | 215/10 | |
| 6,186,856 | B1 * | 2/2001 | Chen | A63H 33/04 | 446/117 |
| D465,246 | S * | 11/2002 | Sorensen | D21/499 | |
| D470,196 | S * | 2/2003 | Sorensen | D21/499 | |
| D519,801 | S * | 5/2006 | Lee | D8/38 | |
| D568,766 | S * | 5/2008 | Nottingham et al. | D9/756 | |
| 7,665,607 | B1 * | 2/2010 | Hanan | 206/457 | |
| 7,775,361 | B2 * | 8/2010 | Ficai | 206/445 | |
| D670,767 | S * | 11/2012 | Ezra et al. | D21/499 | |
| 8,403,723 | B1 * | 3/2013 | Haner | 446/120 | |
| 2005/0035080 | A1 * | 2/2005 | Romero | 215/228 | |
| 2007/0125674 | A1 * | 6/2007 | Ficai | 206/349 | |
| 2013/0015185 | A1 * | 1/2013 | Leal et al. | 220/212 | |
| 2013/0090033 | A1 * | 4/2013 | Vollers et al. | 446/71 | |

FOREIGN PATENT DOCUMENTS

| | | | | |
|---|---|---|---|---|
| DE | 2511375 | A1 * | 10/1976 | |
| FR | 2608066 | A1 * | 6/1988 | |
| GB | 1224484 | A1 * | 1/1968 | B65D 55/02 |
| GB | 2410493 | A * | 8/2005 | |
| IL | 41948 | A * | 1/1977 | |
| WO | WO 9967151 | A1 * | 12/1999 | |
| WO | 0040501 | | 7/2000 | |
| WO | WO 0040501 | A1 * | 7/2000 | |
| WO | 0055063 | | 9/2000 | |
| WO | WO 0055063 | A1 * | 9/2000 | |
| WO | 0205918 | | 1/2002 | |
| WO | WO 2011153598 | A1 * | 12/2011 | |

* cited by examiner

MODULAR BOTTLE CLOSURE FOR COUPLING AND ASSEMBLY

REFERENCE TO CO-PENDING APPLICATIONS

Priority is claimed as a 371 of international of PCT/IL2009/000552, filed on Jun. 2, 2009, which claims priority to Israeli patent application serial number 193662, filed on Aug. 25, 2008.

FIELD OF THE INVENTION

The present invention relates to the field of modular elements. More particularly, the invention relates to a modular closure for occluding the mouth of a bottle, container, and the like.

BACKGROUND OF THE INVENTION

Municipalities are faced with severe ecological challenges as a result of the vast number of disposable bottles, containers and closure caps that are discarded each year and are not biodegradable. The collection and recycling of bottles, containers, and bottle closures is an expensive, time consuming, logistically difficult and inconvenient process.

It would be desirable to provide a modular closure cap (hereinafter "closure") for releasably engaging the mouth of a disposable container, including a bottle for containing a beverage, a ketchup container, a milk container, a mayonnaise container, a toothpaste container, and the like (hereinafter "bottle") of sufficient interest to users to enable reuse thereof and to obviate the need of recycling.

U.S. Pat. No. 4,202,456 discloses a toy comprising a plurality of identical caps attachable one to another to construct a desired assembly. Each cap comprises a threaded body portion adapted for normal attachment to a threaded bottle top, an annular groove on the inside of the bottom portion of the cap, a snap ring at the top of the cap to snap into the annular groove of an identical cap, and a plurality of punch-outs positioned at spaced intervals around the periphery of the cap. A conventional bottle cap has to be modified in order to construct a desired assembly, and therefore a user would tend to discard a bottle cap rather than modifying it in order to employ the disclosed toy due to the time consuming process.

U.S. Pat. No. 5,361,919 discloses a combination bottle cap and stackable toy. The cap in the shape of a polygon is made of plastic by injection molding. Each side has three sets of surfaces having alternating detents and indents form a mating friction fit with corresponding indents and detents of a second cap of the same construction. Due to the presence of the detents and indents, the surfaces of the cap cannot readily display selected indicia, patterns or images.

WO 99/67151 discloses a connection system wherein a bottle cap is fitted with connectors to facilitate horizontal or vertical connection with identical caps. However, both horizontal and vertical connection with identical caps is not possible.

WO 00/40501 discloses a device for unscrewing screw-tops that is configured as a toy building block that can be coupled horizontally with an identical device. However, this device cannot be coupled vertically with an identical device.

It is an object of the present invention to provide a ready to use bottle closure, for closing a bottle mouth upon purchase.

It is an additional object of the present invention to provide a modular bottle closure that captures the interest of users and thereby discourages the discarding of closure caps.

It is an additional object of the present invention to provide a modular bottle closure that can be coupled both horizontally and vertically to both identical and differently configured closure.

It is yet an additional object of the present invention to provide a modular bottle closure that is adapted to display portions of a puzzle, such as a three-dimensional puzzle.

Other objects and advantages of the invention will become apparent as the description proceeds.

SUMMARY OF THE INVENTION

The present invention provides an intriguing modular bottle closure that captures the interest of both children and adults. As a desired construction system, which may be in the form of a two-dimensional or three-dimensional picture, game, and/or figure (hereinafter a "puzzle"), can be assembled from a plurality of closures, users will be encouraged not to discard the bottle closures, thereby providing an ecological benefit while reducing the load on recycling factories.

Since the use of the present invention will encourage users to discard only the bottle, and not the closure, a bottle may be compressed to a greater extent than when it would be discarded together with its closure, thereby saving valuable landfill space. Also, the bottle and closure are generally made from different types of plastic, and therefore cannot be recycled together. By encouraging the discarding of only the bottle, and not the closure, employees of a recycling factory are therefore saved the additional burden of removing a closure from a bottle. An added benefit of fewer closures being discarded is a reduction in the number of animals that die as a result of eating a bottle closure.

The closure comprises one or more exterior surfaces defining a hollow interior, a plurality of spaced engagement elements outwardly protruding from one or more of said exterior surfaces, a bottle cap interface element formed within said interior, and a coupling section coinciding with, or recessed from, a terminal edge of said closure, said coupling section adapted to frictionally engage engagement elements of another closure, whereby to couple together one or more closures. The bottle cap interface element may be an element to which a conventional bottle cap is attachable, or alternatively, may be an element that is formed integrally with means such as threading for releasably engaging the mouth of a bottle.

As the closure of the present invention is considerably greater in size than a conventional bottle cap, the risk that an infant will swallow the closure is therefore prevented.

The plurality of engagement elements are arranged by regions, different portions of the coupling section being selectively engageable with correspondingly different engagement element regions. A side of each engagement element of a region defines a locus of contact surfaces of substantially equal shape and length as the perimeter of a selected coupling section portion.

The inner face of the selected coupling section portion frictionally engages the contact surfaces of a first engagement element region. The outer face of the selected coupling section portion may also frictionally engage the contact surfaces of a second engagement element region, the first and second engagement element regions being separated by a common interspace.

As the coupling section provides wide area engagement, a first coupling section portion may frictionally engage an engagement element region of a first closure and a second coupling section portion may frictionally engage an engagement element region of a second closure.

In one aspect, the closure has a planar upper surface and at least one sidewall perpendicularly extending downwardly from said upper surface. The upper surface may have any desired shape, such as a cross section selected from the group consisting of square, rectangular, circular, semi-elliptical, and triangular.

As referred to herein, the terms "upper" and "lower" are associated with the relative location of a surface of a closure when the coupling section is facing downwardly.

In one aspect, a terminal edge of the at least one sidewall is coplanar with a terminal edge of the coupling section.

In one aspect, a terminal edge of the at least one sidewall is the coupling section.

In one aspect, the plurality of engagement elements protrude from the upper surface.

In one aspect, the bottle cap interface element is a cap receiving element substantially perpendicular to, and downwardly extending from, the upper surface. The bottle cap is fixedly attached to the receiving element by a suitable attachment means whereby the closure and bottle cap rotate in unison when a bottle mouth is opened or closed.

In one aspect, the attachment means comprise circumferentially spaced, vertically disposed elements inwardly protruding from the receiving element, said inwardly protruding elements being adapted to releasably engage corresponding interstices located between adjacent grip segments of the bottle cap.

In one aspect, the attachment means comprise circumferentially spaced, vertically disposed elements inwardly protruding from the receiving element, said inwardly protruding elements being adapted to frictionally engage corresponding indentations formed within the bottle cap.

In one aspect, the bottle cap is irremovably attached to the receiving element. The bottle cap may be configured with an outwardly sloping upper portion and a ring element below said upper portion, and the receiving element may be configured with an upper portion and a portion recessed from, and located below, said receiving element upper portion, said bottle cap upper portion being compressed by said receiving element upper portion and said ring element being received within said recessed portion during engagement between the bottle cap and receiving element, whereby to facilitate irremovable attachment.

In one aspect, the bottle cap is fixedly attached to the receiving element by means of fusion or adhesion.

In one aspect, the bottle cap interface element is formed with threading engageable with a bottle mouth.

In one aspect, a plurality of closures are stackable.

The coupling section may be configured in any desired fashion insofar as the locus of contact surfaces which the selected coupling section portion frictionally engages is similarly configured.

For example, the closure has a square cross section and a tubular coupling section. Corner engagement elements of an underlying closure are received in corresponding sockets of an overlying closure, each of said sockets being defined by two adjacent sidewalls and a corresponding coupling section portion connected to a portion of said two adjacent sidewalls.

When a tubular coupling section is employed, the common interspace between opposing contact surfaces is an arcuate interspace. A first contact surface of a first engagement element region may be convex and a second contact surface of a second engagement element region may be concave, or a first contact surface of a first engagement element region may be concave and a second contact surface of a second engagement element region may be convex, said first and second surfaces being separated by the arcuate interspace. The first contact surface is accordingly separated from the second contact surface by a distance substantially equal to the thickness of the selected coupling section portion In one aspect, the common interspace is a linear interspace.

In one aspect, the plurality of engagement elements protrude from one of the sidewalls, whereby to laterally couple together one or more closures.

In one aspect, a plurality of engagement elements arranged by regions protrude from a first sidewall and a plurality of recessed portions complementary to said plurality of engagement elements are formed in a second sidewall, engagement elements of a first closure being received in the complementary recessed portions of a second closure.

In one aspect, the coupling section of a first closure frictionally engages the engagement elements protruding from the sidewall of a second closure.

The present invention is also directed to a construction system, which is assembled from a plurality of closures, whether two coupled closures that vertically extend from an underlying surface, a second closure that laterally extends from, and is coupled to, a first closure, said first and second closures being parallel to an underlying surface, or two coupled closures obliquely extend from an underlying surface.

A second closure may be suspended in cantilevered fashion when it is laterally coupled to a first closure. The cantilevered closure is sufficiently structurally strong to support a third closure coupled thereto.

In one aspect, a different marking is applied to a surface of each of the plurality of closures, each of said markings constituting a portion of a puzzle that is visible when the construction system is assembled according to a predetermined arrangement.

In one aspect, the puzzle is a three dimensional puzzle.

DETAILED DESCRIPTION OF PREFERRED EMBODIMENTS

The present invention is a novel bottle cap closure to which a bottle cap is fixedly securable. One closure is releasably coupleable with one or more neighboring closures so that various construction systems can be assembled. Selected indicia, patterns or images (hereinafter "markings") can be suitably applied to one wall of the closure so as to be a portion of a puzzle, whereby the entire puzzle may be viewed when the construction system is correctly assembled. In this fashion, users will be encouraged not to discard the bottle caps, thereby reducing the load on recycling factories.

Figure 1A:
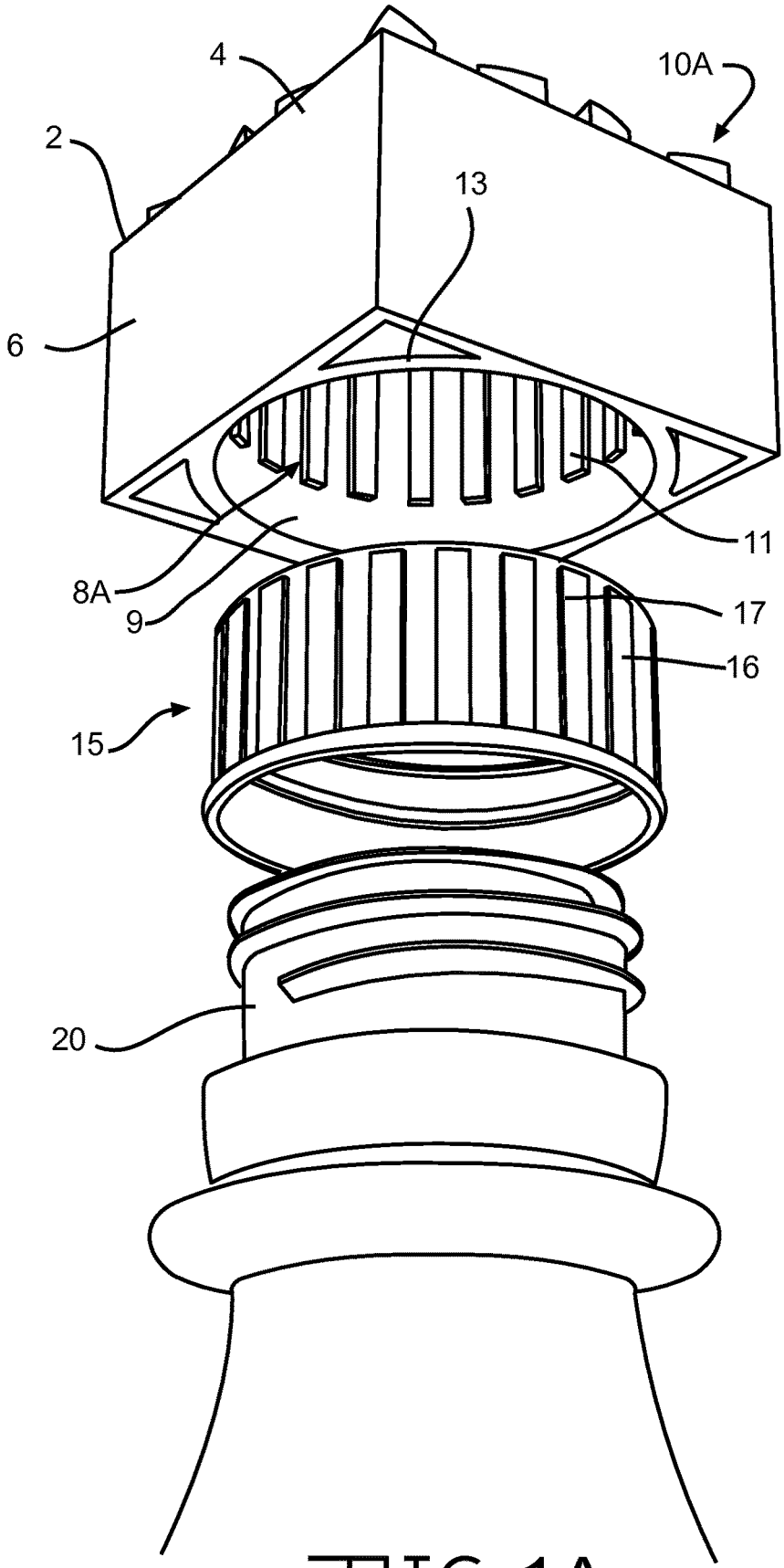
FIG. 1A is a perspective view from the side of an-a closure, according to one embodiment of the invention, showing a bottle cap being secured thereto.

FIG. 1A illustrates a modular bottle cap closure generally indicated by numeral 10A, according to one embodiment of the invention. Closure 10A is a unitary rectilinear toy building member preferably produced by injection molding that has four planar sidewalls 6, a square upper surface 2 from which protrude a plurality of engagement elements 4, and a cap interface element 8A extending from below upper surface 2 throughout the interior of sidewalls 6. Cap interface element 8A comprises tubular wall 9 and circumferentially spaced, vertically disposed elements 11 that inwardly protrude from tubular wall 9. Protruding elements 11 are vertically spaced from bottom edge 13 of tubular wall 9, which is coplanar with the bottom edge of sidewalls 6.

Figure 2:
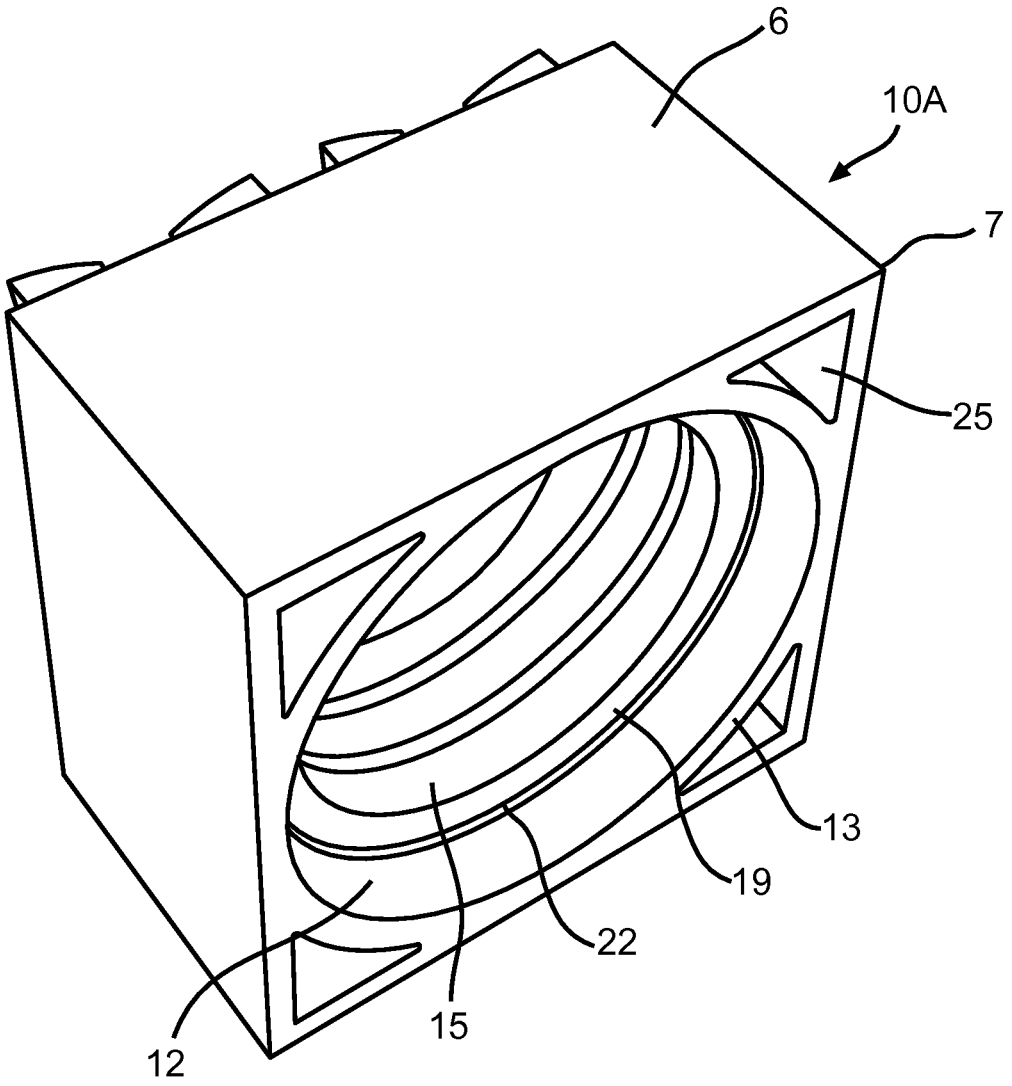
FIG. 2 is a perspective from the rear of the closure of FIG. 1, showing a coupling section vertically extending from an attached bottle cap to a terminal end of the closure.

Protruding elements 11 are adapted to engage corresponding interstices 17 located between adjacent grip segments 16 of conventional bottle cap 15. After cap 15 is introduced to interface element 8A, as shown in FIG. 2, the cap is fixedly attached to tubular wall 9. Bottle cap 15 may be fixedly attached to tubular wall 9 by any other suitable attachment means, such as by fusion or adhesion. Closure 10A will therefore rotate in unison together with cap 15 when the latter is threadedly engaged with bottle mouth 20.

Figure 1B:
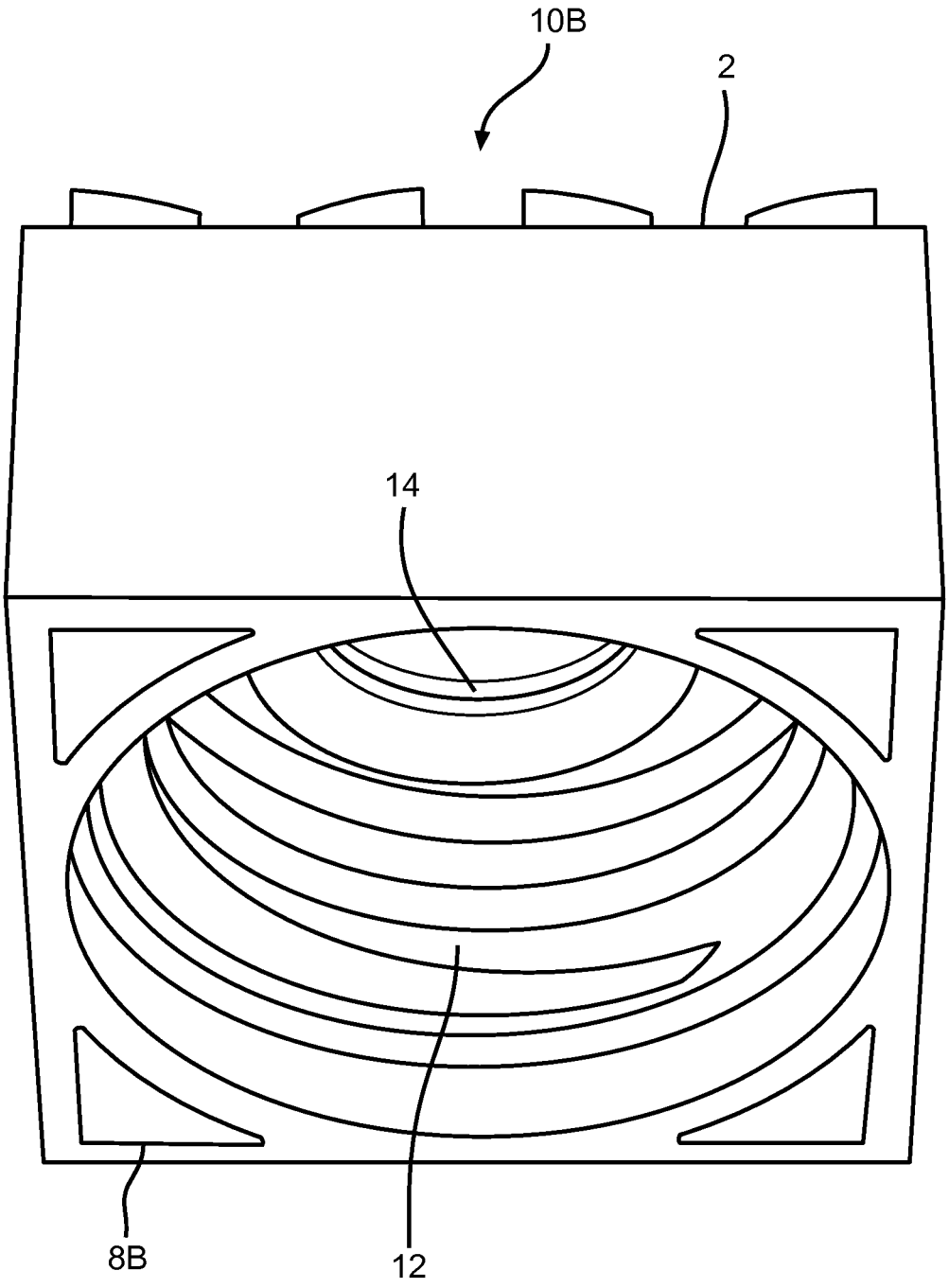
FIGS. 1B-D are a perspective view from the rear of three embodiments, respectively, of a cap interface element.

In FIG. 1B, closure 10B is integrally formed together with the bottle cap. Tubular cap interface element 8B extending from below upper surface 2 throughout the interior of sidewalls 6 has internally formed threading 12, which is engageable with the external threading formed on a bottle mouth. A seal ring 14, which is adapted to abut the free end of the bottle mouth when the latter is fully engaged with threading 12 and to thereby prevent the escape of diffused gases, extends from the underside of upper surface 2 and is concentric with interface element 8B.

Figure 1C:
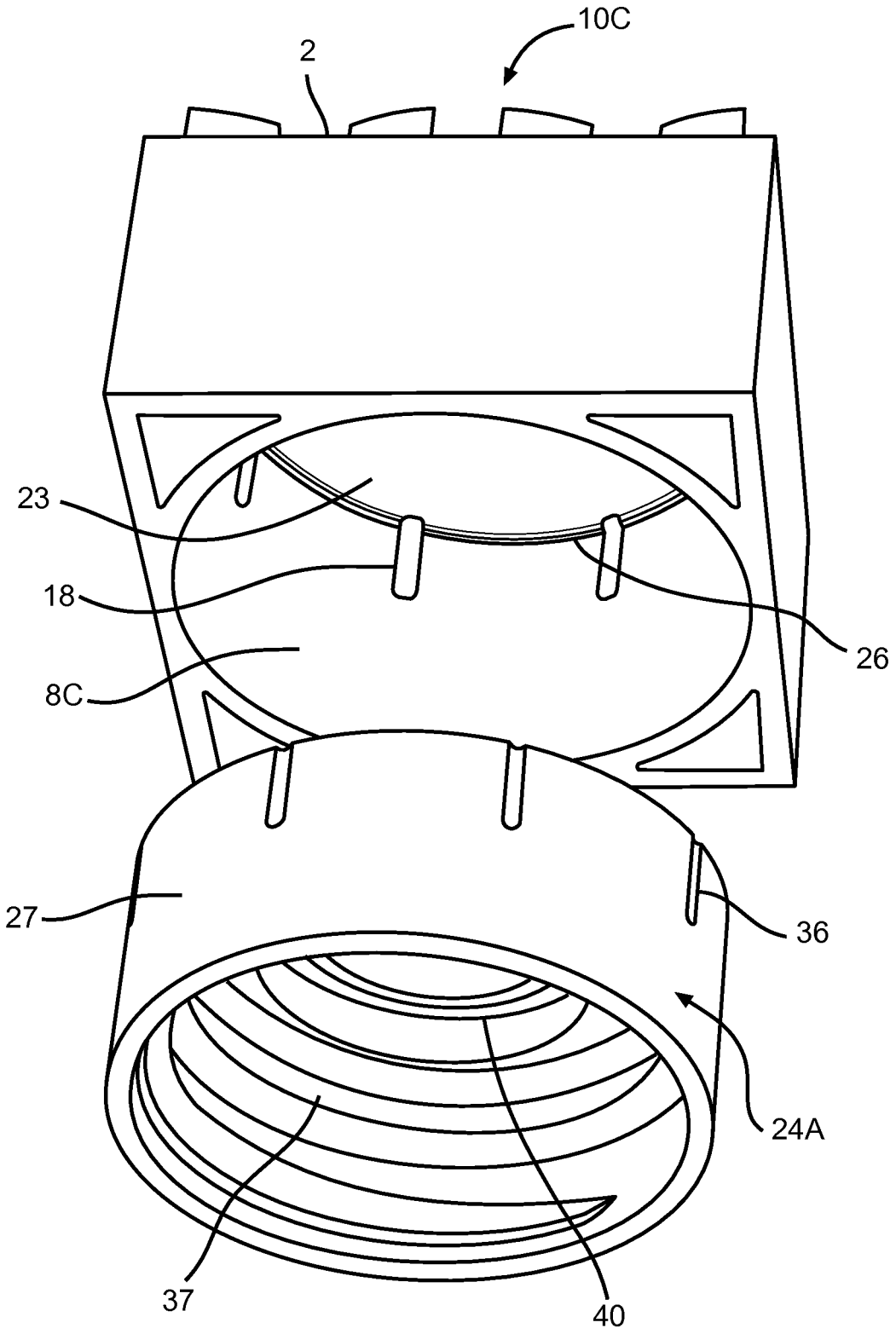

In FIG. 1C, the inner tubular face of cap interface element 8C is formed with a plurality of circumferentially spaced, vertically oriented protrusions 18 that downwardly extend from circular junction 26 adjoining underside 23 of surface 2 and interface element 8C. A dedicated bottle cap 24A is fixedly attachable to closure 10C by means of a plurality of circumferentially spaced, vertically oriented indentations 36 that are formed in the upper end of its cylindrical wall 27. Each protrusion 18 is received in, and frictionally engaged with, a corresponding indentation 36. Bottle cap 24A also has a seal ring 40, and its wall 27 is formed with internal threading 37. If so desired, bottle cap 24A may be detached from interface element 8C and replaced by another bottle cap.

Figure 1D:
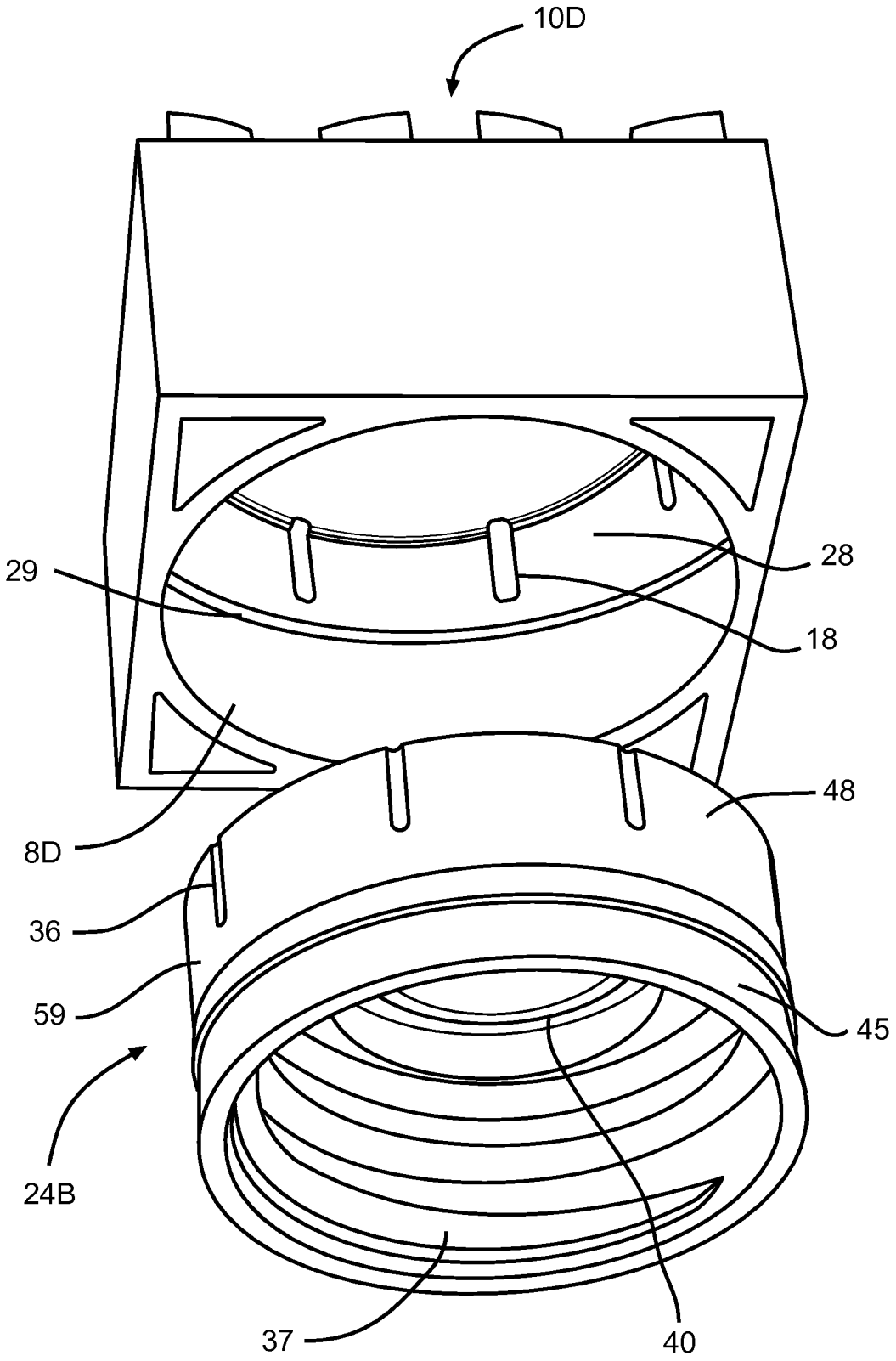

In FIG. 1D, outer wall 45 of bottle cap 24B fixedly and irremovably engageable with interface element 8D is frustoconical. The shape of interface element 8D is similar to wall 45, and protrusions 18 formed in an outwardly sloping upper portion 28 of interface element 8D are frictionally engageable with indentations 36 formed in an upper portion 48 of wall 45. Bottle cap 24B is provided with an outwardly protruding ring element 59 that is disposed directly below upper portion 48, while interface element 8D is formed with a complementary recessed annular portion 29 directly below upper portion 28. The outwardly sloping upper portion 28 of wall 45 becomes compressed by upper portion 28 of interface element 8D when engaged therewith. The disengagement of bottle cap 24B from interface element 8D is prevented after ring element 59 is received in annular portion 29. Bottle cap 24B also has a seal ring 40, and its wall 45 is formed with internal threading 37.

Figure 8A:
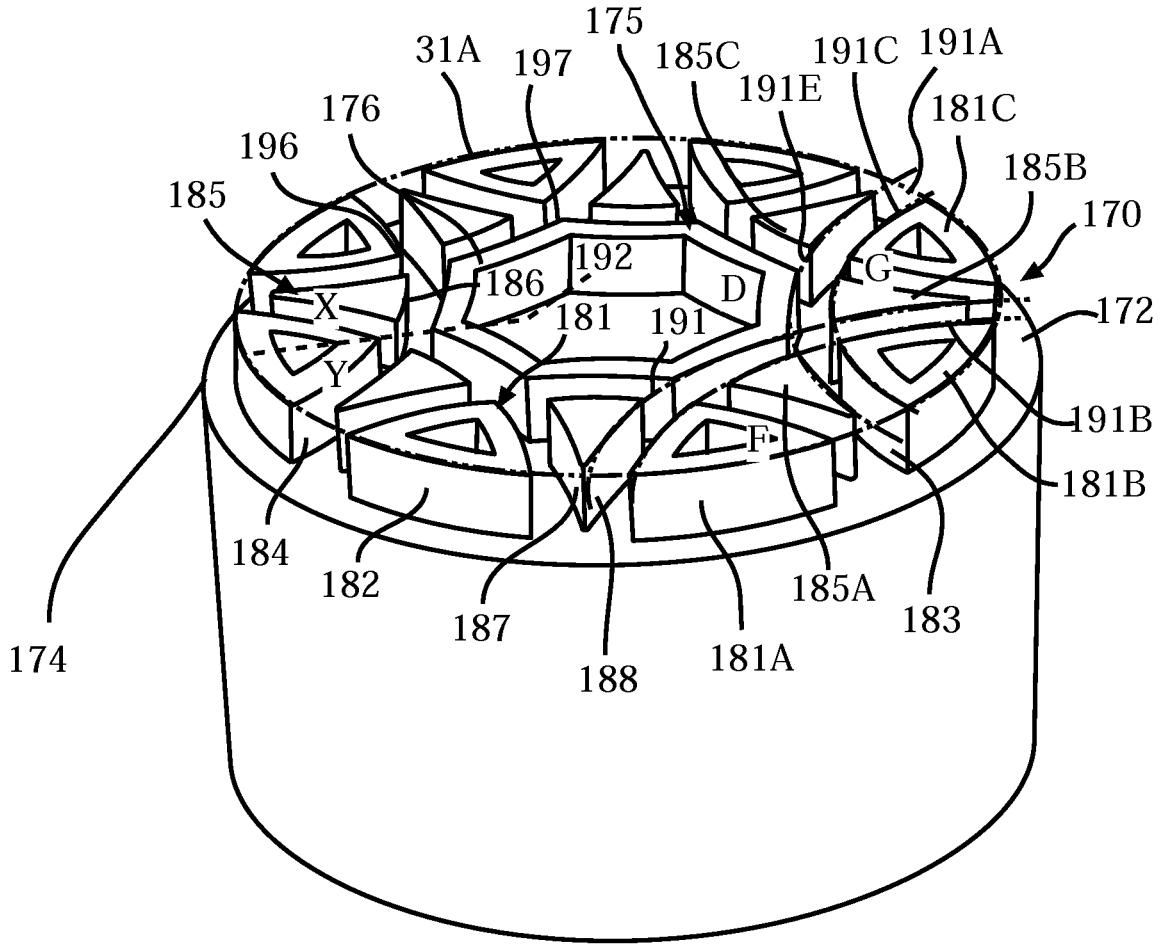
FIG. 8A is a perspective view from the top of a closure provided with a centrally located guide element.
Figure 8B:
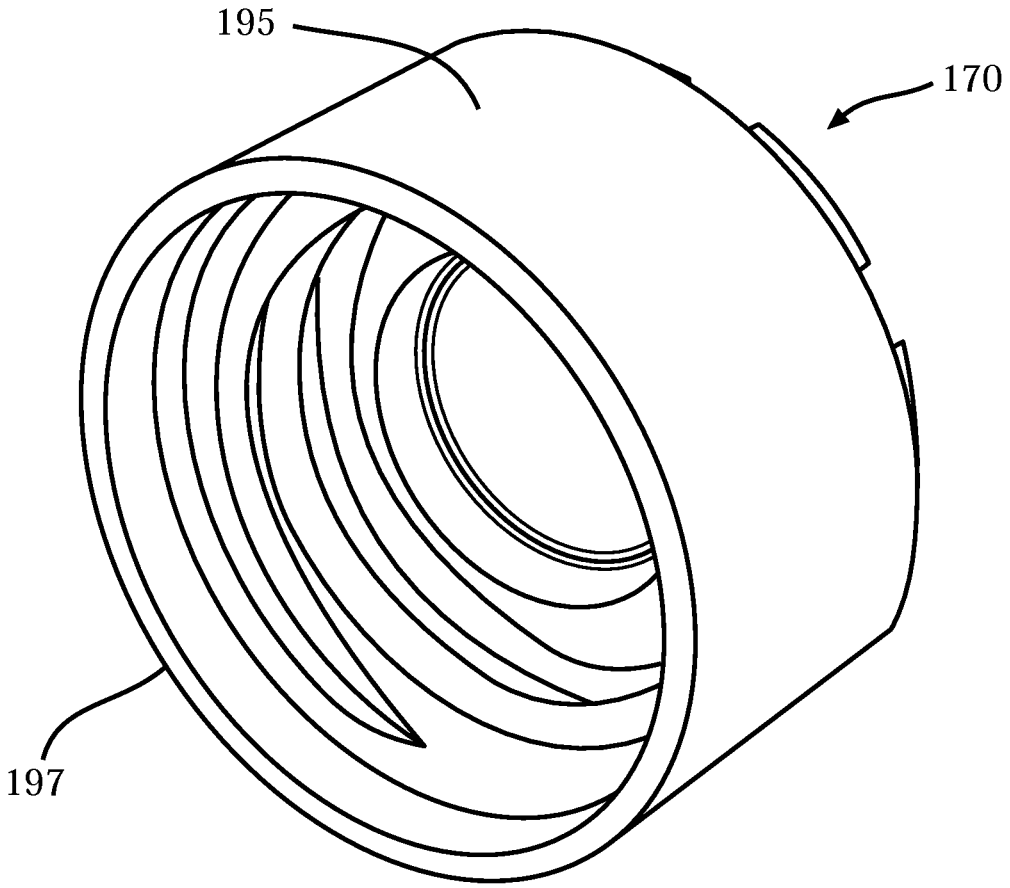
FIG. 8B is a perspective view from the rear of the closure of FIG. 8A.

In FIG. 8, closure 10 comprising a cap fixedly attached thereto by means of any of the aforementioned interface elements is shown to be in complete occluding relation with the mouth of bottle 1.

Referring back to FIGS. 1A and 2, the portion of tubular wall 9 vertically extending between bottom edge 13 thereof and bottom edge 19 of cap 15 and circumferentially extending from a connection portion 22 with one sidewall 6 to another constitutes a coupling section 21, for releasable frictional engagement with engagement elements of an adjacent closure, as will be described hereinafter. Four triangular sockets 25 are defined by a coupling section 21 and two sidewalls 6 extending to a common corner 7.

Figure 3:
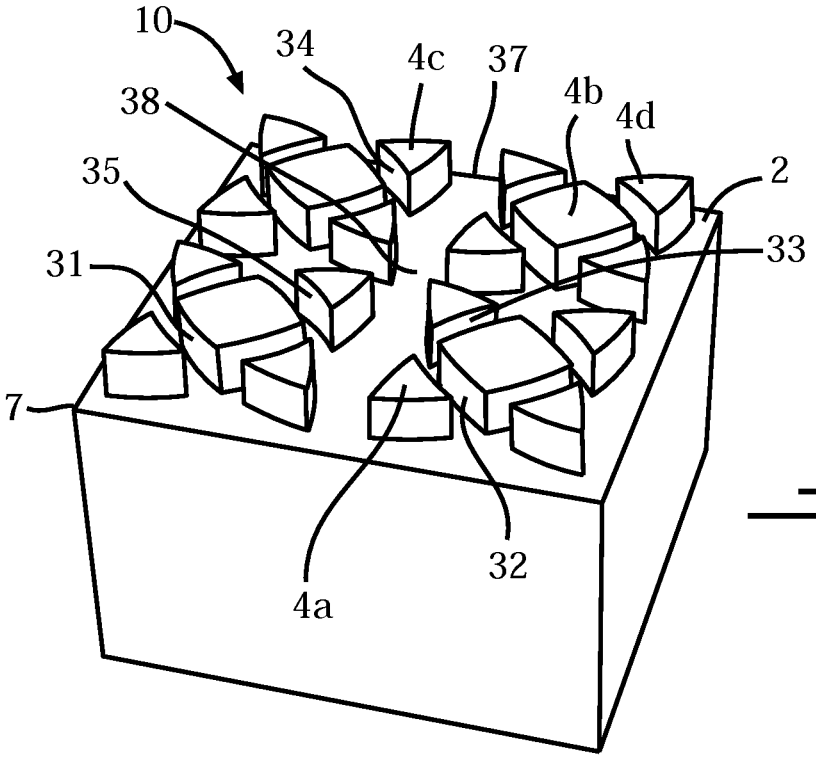
FIG. 3 is a perspective view from the top of a closure, according to one embodiment of the invention, showing the provision of a plurality of engagement elements protruding from the upper surface thereof and of a plurality of linear and arcuate interspaces formed between adjacent engagement elements.

The various engagement elements of an exemplary closure 10 are illustrated in FIG. 3. All of the engagement elements are male elements, protruding from upper surface 2 so as to be frictionally engageable with the coupling section 21 of another closure positioned above closure 10. Each of the engagement elements has at least one arcuate side surface of a substantially similar curvature as that of coupling section 21, and preferably has a planar top surface for simplified molding. To enable engagement with the coupling section 21 of an overlying closure, an interspace is provided between adjacent engagement elements.

Four engagement elements 4*a-d* of closure 10 are indicated, being oriented in such a way and spaced from adjacent engagement elements so as to produce a plurality of arcuate insterspaces, e.g. interspaces 31-35, and a plurality of linear interspaces, e.g. interspaces 37 and 38. The width of an arcuate interspace is substantially equal to the thickness of coupling section 21, while the width of a linear interspace is significantly greater than that of an arcuate interspace to allow for the placement therein of a sidewall 6 of closure 10. A corner element 4*d* is positioned proximate to a corresponding corner 7 of closure 10 and radially outwardly from arcuate interspace 31.

Figure 4:
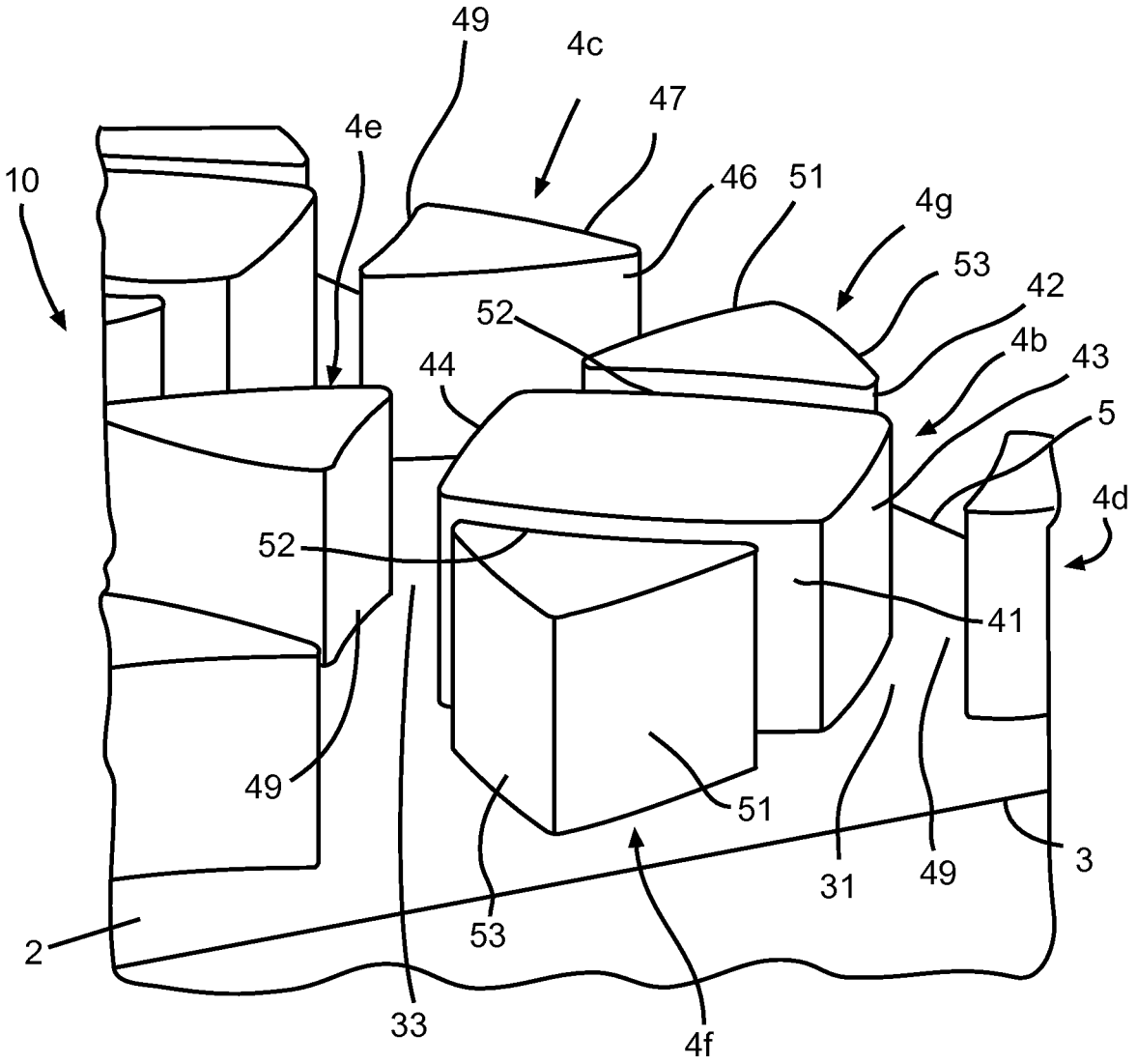
FIG. 4 is an enlarged perspective view from the top of a closure similar to the closure of FIG. 3, showing the configuration of various engagement elements.

The configuration of some of the engagement elements is shown in greater detail in FIG. 4. The upper surface of these engagement elements is substantially parallel to upper surface 2 of the closure. Engagement element 4*b* is substantially rectilinear, having parallel and equally sized side surfaces 41 and 42, and opposing convex surfaces 43 and 44 extending between parallel surfaces 41 and 42. Engagement element 4*c* is substantially triangular, having two planar and equally sized sides 46 and 47, and concave surface 49 extending between sides 46 and 47. Engagement element 4*g* is substantially triangular, having two planar and equally sized sides 51 and 52, and convex surface 53 extending between sides 51 and 52. The dimensions and proportions of the engagement elements may be changed in accordance with design constraints. It will also be appreciated that engagement elements of other configurations may also be provided.

An arcuate insterspace 33 is shown to be formed by selectively positioning the engagement elements. Engagement element 4*b* is positioned such that its sides 41 and 42 are oblique to edge 3 of closure upper surface 2. Engagement element 4*g* is positioned such that its side 52 is slightly spaced from, and parallel to, side 42 of engagement element 4*b*. Engagement element 4*f*, which has a similar configuration as engagement element 4*g* but oppositely oriented therefrom, is positioned such that its side 52 is slightly spaced from, and parallel to, side 41 of engagement element 4*b*. Convex surface 53 of engagement element 4*f*, convex surface 44 of engagement element 4*b*, and side 51 of engagement element 4*g* trace an arcuate line. Engagement element 4*e*, which has a similar configuration as engagement element 4*c*, is positioned such that its concave surface 49 is spaced from, and concentric to, convex surface 44 of engagement element 4*b*. Thus arcuate insterspace 33 is formed by convex surface 53 of engagement element 4*f*, convex surface 44 of engagement element 4*b*, and side 51 of engagement element 4*g*, and by concave surface 49 of engagement element 4*e*. Coupling section 21 (FIG. 2) of an overlying closure will therefore be in frictional engagement with concave surface 49 of engagement element 4*e* and with convex surface 44 of engagement element 4*b*, thereby securing the overlying closure to closure 10 by a wide area engagement.

An arcuate interspace 31 is also formed between convex surface 43 of engagement element 4*b* and concave surface 49 of engagement element 4*d*, which is similarly configured as engagement element 4*c*, and by the arcuate line traced by side 51 of engagement element 4*f*, convex surface 43 of engagement element 4*b*, and by convex surface 53 of engagement element 4*g*.

The dimensions and proportions of the engagement elements illustrated in FIG. 4 are such that arcuate interspaces 31 and 33 are formed, as described hereinabove, and such that a linear interspace is formed between the pair of engagement elements 4*b* and 4*g*, and between 4*b* and 4*f*. These relatively narrow linear interspaces facilitate the frictional engagement with a rectilinear coupling section as shown in FIG. 14B. When the dimensions and proportions of the engagement elements are those as illustrated in FIG. 6B, the side surfaces of the engagement elements are slightly rounded, wherein a side surface of a first engagement element is convex and a side surface of a second engagement element adjacent to said side surface of the first engagement element is concave, so as to form an arcuate interspace therebetween.

The engagement elements protruding from closure upper surface 2 are advantageously arranged by regions wherein a region includes a plurality of engagement elements. As an interspace is provided between adjacent engagement elements, an engagement element may be associated with more than one region, to allow an overlying closure to be coupled with an underlying closure in many different ways. For example, the engagement elements of closure 10 are arranged by rectangular regions A and B (FIG. 5), which are separated by linear interspace 37 (FIG. 3). The engagement elements of closure 10 are also arranged by curved regions C (FIG. 5), D (FIG. 6A) and E (FIG. 6B).

Figure 5:
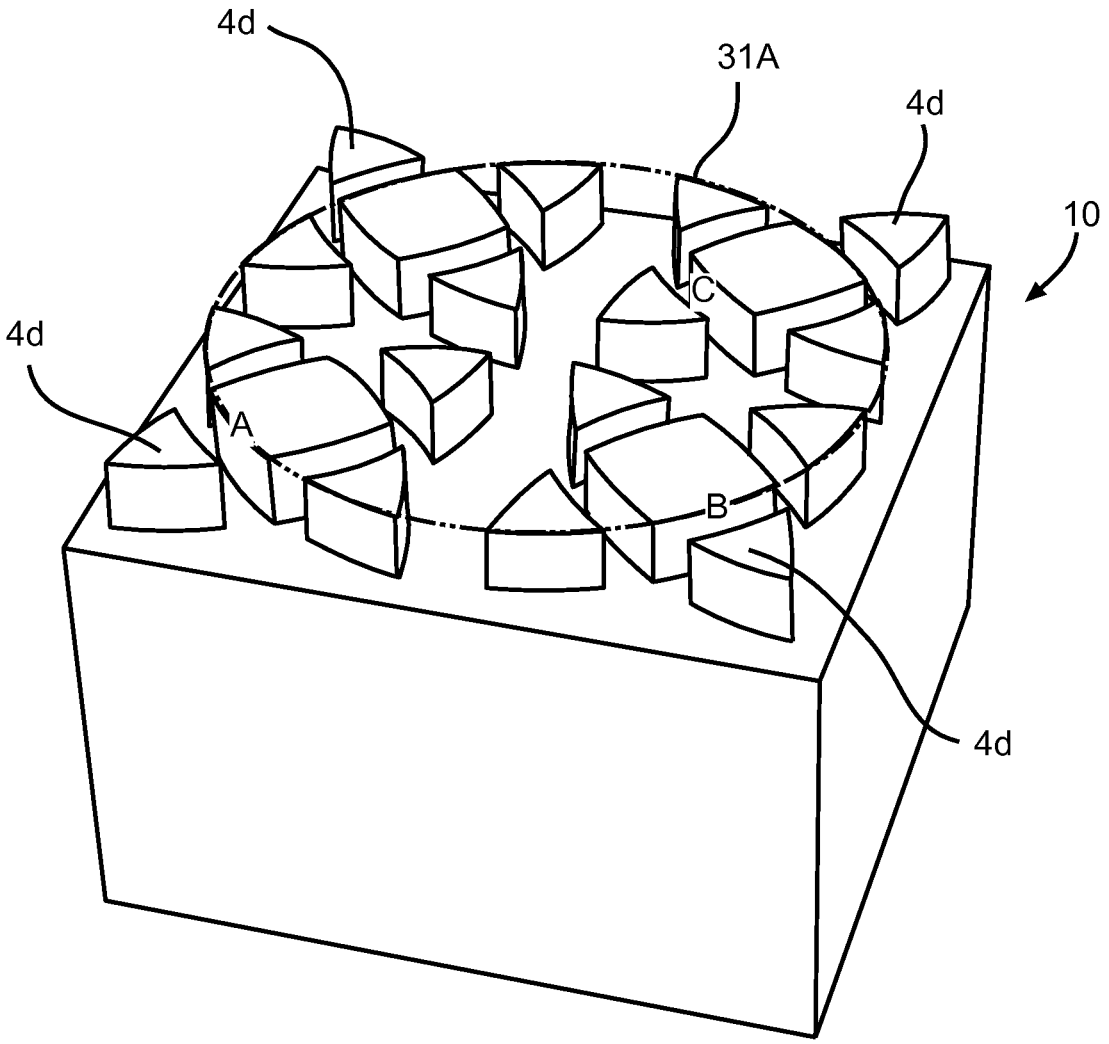
FIGS. 5, 6A, and 6B are a perspective view from the top of the closure of FIG. 3, showing various surface loci defined by the engagement elements.

One distinctive region is the centrally located curved region C shown in FIG. 5. Region C is defined by a plurality of arcuate insterspaces 31 illustrated in FIGS. 3 and 4, each of which separating a corner engagement element 4*d* from an adjacent rectilinear engagement element 4*b*, and by a circular locus 31A of contact surfaces. Accordingly, coupling section 21 (FIG. 2) of an overlying closure frictionally contacts the arcuate surfaces of the engagement elements defining region C, so that two closures 10 can be stacked one on top of the other. Corner engagement element 4*d* are configured to be received in corresponding sockets 25 (FIG. 2) of the overlying closure. A conventional bottle cap may also be placed in frictional engagement with locus 31A.

Figure 6A:
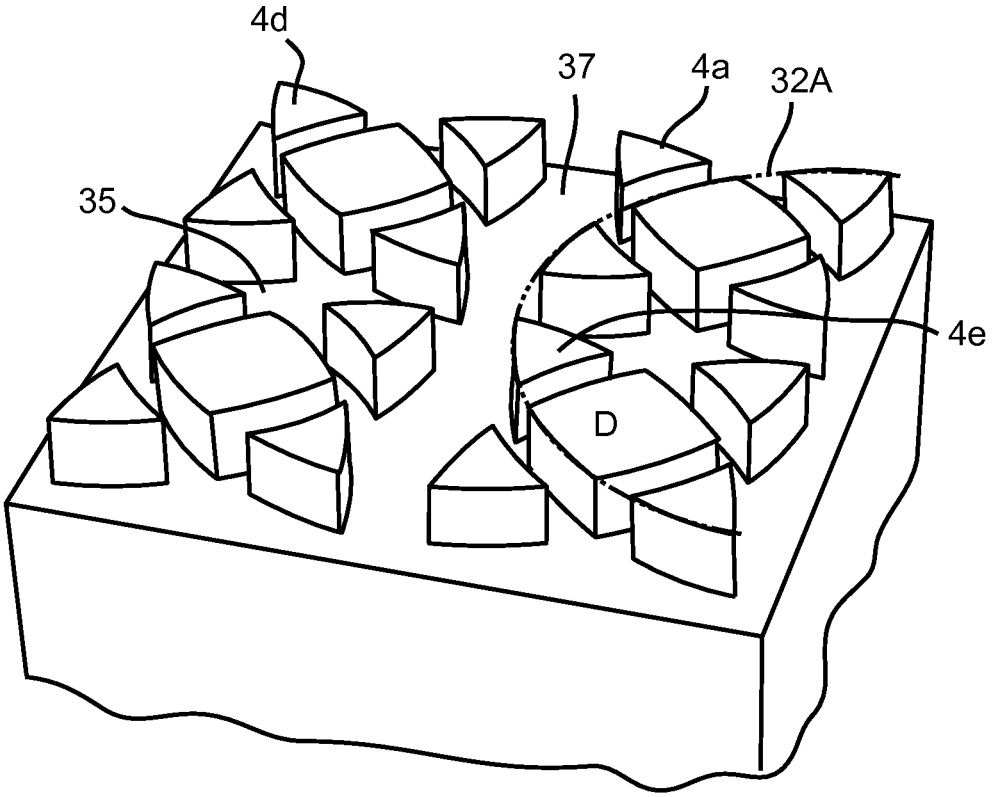
Figure 6B:
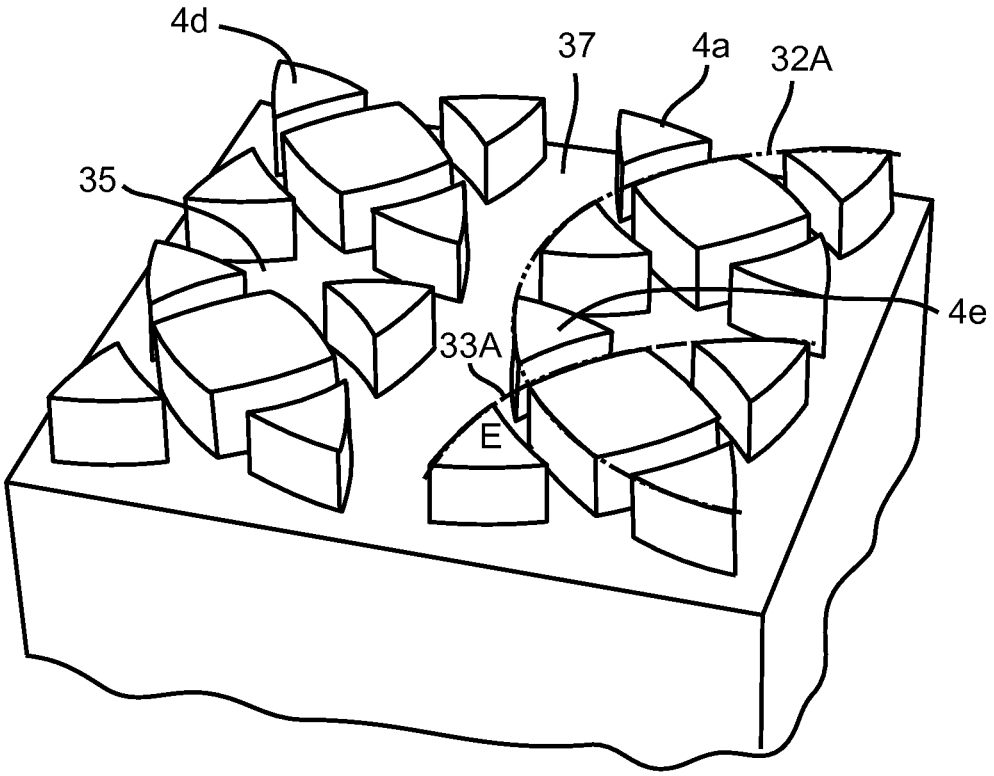

After two closures are placed in side by side abutting relation, the coupling section of a third closure can secure the three closures together when contacting each of the semicircular surface loci 32A shown in FIG. 6A of the two horizontally abutting closures and introduced into each of the arcuate interspaces 32 shown in FIG. 3. A sidewall 6 (FIG. 1) of an overlying closure is adapted to be placed within the linear interspace 37 of an underlying closure, while engagement elements 4*a* are adapted to be received in corresponding sockets 25 (FIG. 2) of the overlying closure. Thus a closure is suitable for both vertical and horizontal coupling.

After four closures are placed in side by side abutting relation, the coupling section of a fifth closure can secure the five closures together when introduced into each of the quarter-circular interspaces 33 shown in FIGS. 3-4 and contacting each of the quarter-circular surface loci 33A shown in FIG. 6B of the four horizontally abutting closures. Two sidewalls 6 (FIG. 1) of an overlying closure are adapted to be placed within the linear interspaces 35 and 37, respectively, of an underlying closure, while engagement element 4*e* is adapted to be received in a corresponding socket 25 (FIG. 2) of the overlying closure.

Figure 7:
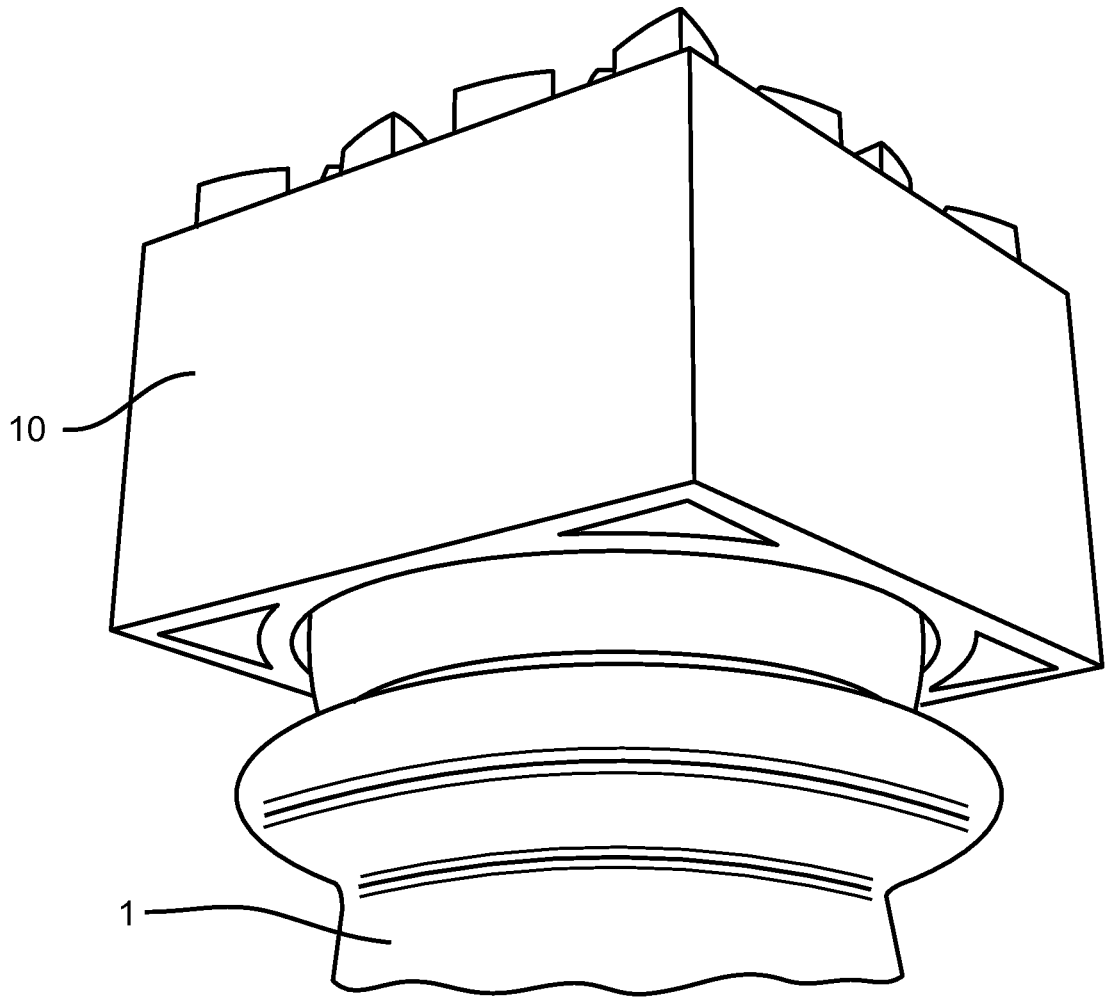
FIG. 7 is a perspective view of the closure of FIG. 3 in occluding relation with the mouth of a bottle.

As shown in FIG. 7, a closure 10 may have a square configuration, a closure 60 may have a semi-elliptical configuration, and a closure 70 may have a circular configuration. The engagement elements of closure 60 define a circular locus of surfaces 31A, while two engagement elements 4*d* are provided outwardly from locus 31A. Similarly, any other desired closure configuration, such as a triangular or rectangular configuration, may be employed.

An exemplary construction system 90 assembled from the closures of the present invention is illustrated. For example, two closures 60*a* and 60*b* are positioned in abutting end to end relation to provide a combined elliptical closure configuration, to the top of both is coupled an interfacing square closure 10*a*. A square closure 10*b* is coupled to a semi-elliptical closure 60*c* and to another underlying closure in abutment with closure 60*c*. Two stacked circular closures 70*a* and 70*b* are coupled to square closure 10*b*.

Figure 9A:
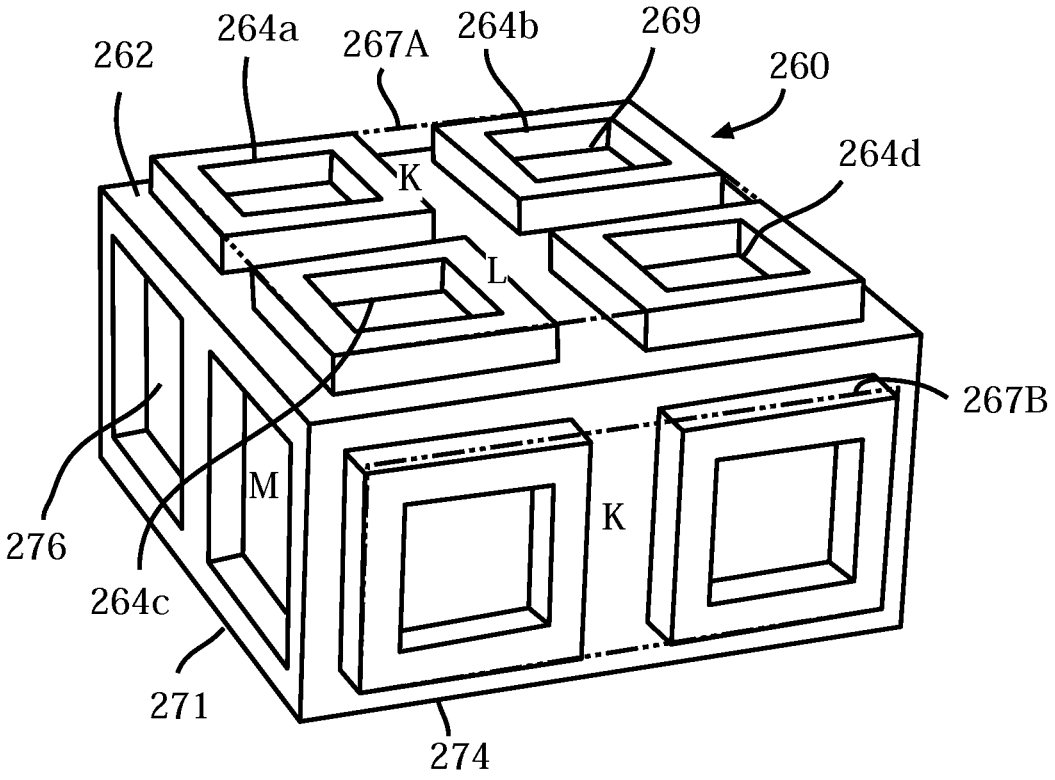
FIG. 9A is a perspective view from the top of a closure provided with square engagement elements.
Figure 9B:
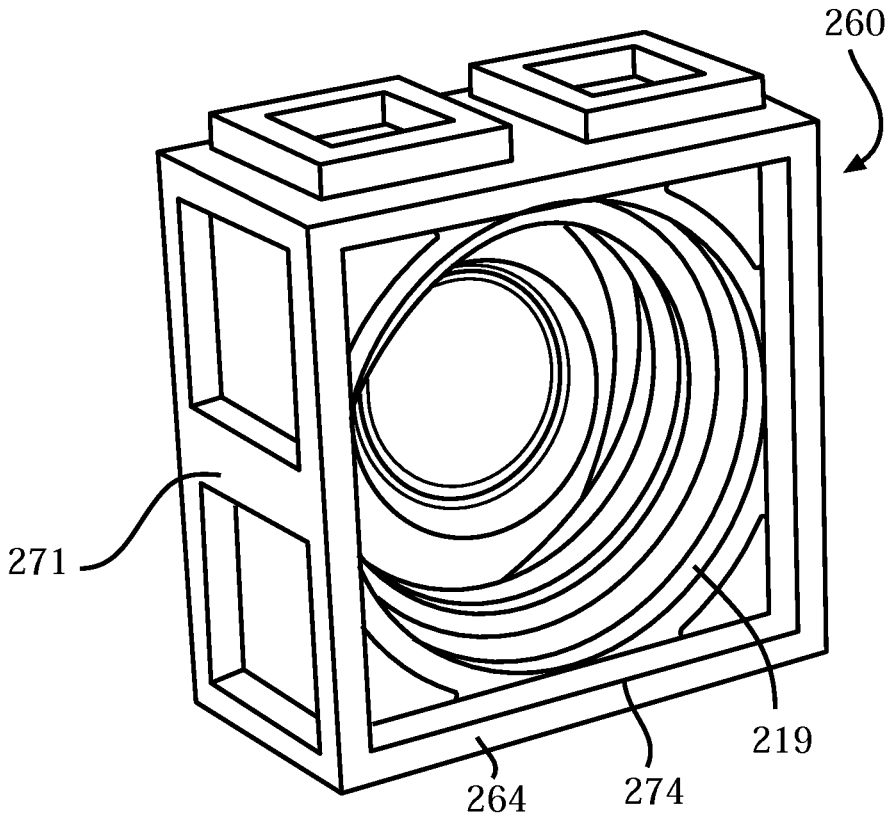
FIG. 9B is a perspective view from the rear of the closure of FIG. 9A.

FIG. 9 illustrates a construction system 110 that can be assembled from a plurality of closures 10. In this construction system, the sidewalls 6 (FIG. 1) of all of the closures are aligned to define a single vertically disposed wall 111. A different marking 115 is applied to a sidewall 6 of each closure, so that when the construction system is correctly assembled, a unique combined marking 117, e.g. a representation of a cow as illustrated, may be viewed on wall 111.

Since adjacent engagement elements of each closure are spaced by selected linear or arcuate interspaces, a closure can be coupled with one or more differently configured closures. As a construction system comprising a plurality of horizontally and vertically extending coupled closures can therefore be assembled, the closures of the present invention may be coupled together in such a way to provide a three-dimensional puzzle that may be viewed only when the closures are assembled in one unique fashion. As opposed to a two-dimensional puzzle wherein all the markings are applied to coplanar surfaces, a plurality of surfaces defining a three-dimensional puzzles and to each of which may be applied a marking are disposed on different planes.

FIGS. 11A and 11B illustrate a circular closure 170 provided with an octagonal guide element 175 protruding from a central region of upper surface 172, for facilitating the frictional engagement of a coupling section with the engagement elements and for simplifying the molding of the closure. Each concave side 176 of guide element 175 is identical.

In this embodiment, two types of engagement elements are employed: element 181 configured similarly to an equilateral triangle and having three convex sides 182-184, and element 185 having a convex side 186 facing a corresponding side 176 of guide element 175 and two concave sides 187 and 188 facing a side of an adjacent engagement element 181. Eight engagement elements 181 protruding from surface 172 are equidistantly and circumferentially spaced one from another, and are positioned such that each outer side 182 thereof is substantially concentric with, and slightly spaced from, periphery 174 of upper surface 172, thereby defining a circular locus 31A of contact surfaces adapted to be frictionally engaged with a coupling section 197 of another closure located at the terminal end of sidewall 195. By positioning each engagement element 181 such that a line 192 bisecting side 182 of an engagement element 181 coincides with apex 196 adjoining sides 183 and 184 thereof and with corresponding apex 197 adjoining two adjacent sides 176 of guide element 175, two arcuate interspaces X and Y can separate the sides 183 and 184, respectively, of each engagement element 181 from an adjacent engagement element 185.

To simplify the frictional engagement of a coupling section, an engagement element 181 is positioned such that it is common to two engagement element regions. As shown, region F comprises engagement elements 181A, 185A, and 181B, while region G comprises engagement elements 181C, 185B, and 181B. Quarter-circle locus 191B is therefore defined by contact surface 183 of element 181A, contact surface 186 of element 185A, and surface 184 of element 181B. Since an arcuate interspace Y separates locus 191B from locus 191D coinciding with contact surface 187 of element 185B and a side 176 of guide element 175, a coupling section portion to be frictionally engaged with loci 191B and 191D can be inserted within this arcuate interspace while being assisted by guide element 175.

If it is easier or more comfortable to a user, the coupling section portion may also be frictionally engaged with locus 191C, which is defined by contact surface 183 of element 181B, contact surface 186 of element 185B, and contact surface 184 of element 181C, and with locus 191E, which is defined by contact surface 187 of engagement element 185C, a side of guide element 175, and contact surface 188 of element 185A.

FIG. 12 illustrates an exemplary openwork construction system 210 that can be assembled with a plurality of closures 170. Two spaced second level closures 170B and 170C are coupled to an underlying first level closure 170A. A third level closure 170D located directly above first level closure 170A is coupled to second level closures 170B and 170C, to provide an opening 205 between closures 170A and 170D. It will be appreciated that three overlying closures can be coupled with an underlying closure 170.

Any of the aforementioned closures can be provided with engagement elements laterally protruding from a sidewall, to increase the versatility of a construction system assembled from the closure and the complexity of a three dimensional puzzle.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A bottle closure, comprising:

a) one or more exterior surfaces including a planar upper surface and at least one sidewall extending perpendicularly downwardly from said upper surface, said at least one sidewall defining a hollow interior and forming a bottom terminal edge of the bottle closure;

b) a bottle cap interface element formed within said hollow interior substantially perpendicular to, and downwardly extending from, the upper surface;

c) a bottle cap, irremovably attached to the cap interface element;

d) a plurality of spaced engagement elements outwardly protruding from the upper surface, enabling the cap interface element to be connected modularly to another cap interface receiving and create a modular toy;

e) a coupling section recessed from the terminal edge of the bottle closure, said coupling section adapted to frictionally engage the engagement elements of a second bottle closure when the engagement elements of the second bottle closure are introduced into said coupling section, thereby coupling together the bottle closures;

the coupling section and at least two adjacent sidewalls further define one or more sockets that receive an engagement element of a second bottle closure;

f) the plurality of engagement elements having a design enabling a square cap interface element to connect to a circular cap interface element and vice versa (enabling the circular cap interface element to connect to a square cap interface element);

g) the cap interface element with a bottom terminal edge surrounded by the sockets formed by the coupling sections enabling total or part connection to the upper surface of another square and/or circular cap receiving element from each element from each corner.

2. The bottle closure according to claim 1, wherein the bottle cap is fixedly attached to the interface element whereby the rotation of the bottle closure will rotate the interface element and bottle cap in unison when the bottle closure is rotated relative to a bottle upon opening or closing of the bottle.

3. The bottle closure according to claim 2, wherein the attachment of the bottle cap to the cap interface element comprise circumferentially spaced, vertically disposed elements inwardly protruding from the cap receiving element.

4. The bottle closure according to claim 2, wherein the bottle cap is fixedly attached to the cap interface element by means of fusion or adhesion.

5. The bottle closure according to claim 1, wherein a plurality of closures are stackable.

6. The bottle closure according to claim 5, wherein the bottle closure has a square cross section and a tubular coupling section.

7. The bottle closure according to claim 1, wherein the upper surface has a cross section having a shape selected from the group consisting of square, rectangular, circular, semi-elliptical, and triangular.

8. The bottle closure according to claim 1, wherein a terminal edge of the at least one sidewall is coplanar with a terminal edge of the coupling section.

9. The bottle closure according to claim 2 wherein the bottle cap comprises interstices on the outer surface of the bottle cap.

10. The bottle closure according to claim 1, wherein:

the bottle cap comprises a ring element that protrudes from a side wall of the bottle cap; and the receiving element is configured with a recepsed annular portion shaped to receive the ring element comprised in the bottle cap when the bottle cap is engaged with the receiving element.

11. The bottle closure according to claim 10, wherein the bottle cap is configured with an outwardly sloping upper portion above the ring element, wherein said bottle cap upper portion is compressed by said cap receiving element when the bottle cap is engaged with said cap receiving element.

* * * * *